United States Patent [19]

Nordentoft

[11] 3,979,064

[45] Sept. 7, 1976

[54] SHOWER HEAD

[75] Inventor: Lars Nordentoft, Menden, Germany

[73] Assignee: ITT Industries, Inc., New York, N.Y.

[22] Filed: Nov. 6, 1975

[21] Appl. No.: 629,485

[30] Foreign Application Priority Data

Dec. 14, 1974 Germany ..... 2459316

[52] U.S. Cl. ..... 239/107; 239/535; 239/541

[51] Int. Cl.[2] ..... B05B 1/14

[58] Field of Search ..... 239/535, 537, 107, 109, 239/541, 562, 570, 583, 546, 542; 138/45, 43, 46

[56] References Cited

UNITED STATES PATENTS

| | | | |
|---|---|---|---|
| 2,874,001 | 2/1959 | Webb | 239/535 |
| 3,282,508 | 11/1966 | Roberts | 138/45 X |
| 3,719,328 | 3/1973 | Hindman | 239/546 |
| 3,876,151 | 4/1975 | Katva | 239/562 X |

*Primary Examiner*—John J. Love

*Attorney, Agent, or Firm*—James B. Raden; William J. Michals

[57] ABSTRACT

A shower head is disclosed for regulating water flow. Improvements enable a constant shower spray to be produced even though changes may occur in the pressure in the main lines. According to the invention, this is brought about by arranging outlet holes of the shower head in a flexible diaphragm-like disc held in the shower head casing by its edge. This disc reacts to slight changes in main line pressure to flex and adjust the volume of water within the head, thereby adjusting the resultant pressure within the head to compensate the change to main line pressure. This flexure of the disc also dislodges lime deposits and the like from the outlet holes, thereby providing a self-cleaning function.

7 Claims, 1 Drawing Figure

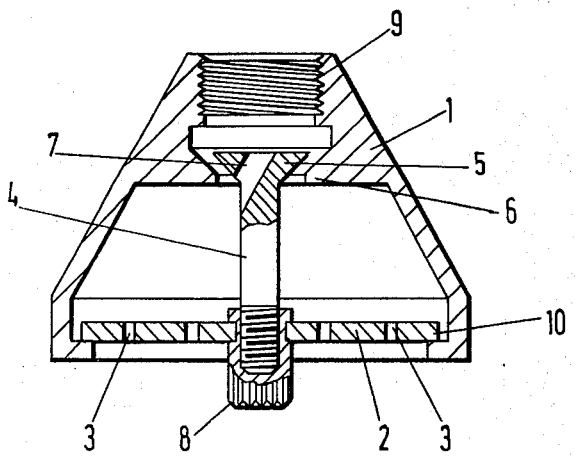
9
1
7
5
4
6
10
3
8
2
3

SHOWER HEAD

BACKGROUND OF THE INVENTION

1. Field of the Invention

The invention relates to a shower head with water outlet holes and to means for regulating the flow of water in such a way that a constant shower spray is produced which is not affected by changing pressures in the main lines.

2. Description of the Prior Art

A control device with fins in the direction of flow to guide the water arranged in a shower head ahead of the entry point to the individual rose holes in such a way that the flow of water in the flow slits can be fed to the holes in controlled jets is known by virtue of the German Pat. No. 881,027.

The disadvantage of that system is that shower jets of varying forms are produced when, as is often the case, pressure variations occur in the mains supply lines. In particular when pressure increases above the normal value occur in the mains lines, thin, hard jets of water are produced by the shower head which are commonly regarded as unpleasant.

In addition, with known shower heads, there is the disadvantage that the outlet holes in the base of the shower head through which the shower water emerges become obstructed in a relatively short period of time by lime deposits and impurities and the jet pattern of the emergent water becomes highly irregular.

SUMMARY OF THE INVENTION

This invention is based upon the need to improve known shower heads in such a way that a constant spray is produced which is not affected by changing pressures in the mains lines, by lime deposits, and the like. According to the invention, this is brought about by arranging the outlet holes in a flexible, diaphragm-like disc held in the shower head casing by its edge. The disc is supported by one end of a valve rod having a valve cone at the other end which fits on a valve seat in the shower head. Further characteristics of the invention will be apparent from the claims.

The advantages which are obtained by the practice of this invention consist in particular in the fact that the water pressure ratio in the space between the valve seat and the disc can, on the one hand, by means of the flexible disc, be maintained constant in contrast to the mains pressure and, on the other hand, by the fact that the disc, as a diaphragm, undergoes slight buckling when changes in pressure occur in the mains supply system permitting lime and dirt deposits to be dislodged and swept away. In addition, it is possible to change the length of the valve rod by means of a screw or a lever mounted with access from outside thus affording the possibility of having either a constant shower pattern under changing pressure ratios or, under constant pressure ratios, of setting the shower pattern from parallel to diverging shower jets or vice versa.

BRIEF DESCRIPTION OF THE DRAWING

An embodiment of the patent is shown diagrammatically in the illustration in cross-section and will be described in greater detail below.

DESCRIPTION OF A PREFERRED EMBODIMENT

A disc 2 with through apertures 3, is supported by its edge 10 in a shower head casing 1, having a connecting socket 9 for the mains supply line. A rotatable, axially fixed adjusting nut 8 is embedded in a concentric hole in the disc 2. A valve rod 4 with valve cone 5 is screwed into the nut 8. The valve cone 5 is fitted to a valve seat 6 in the form of an intermediate bottom. To secure the through flow of a minimum amount of water, the valve cone 5 is provided with a hole 7 as a bypass.

The shower head functions as follows:

The shower water enters the shower head through the aperture 9 and the pressure in the water line acts upon the inner surface of the disc. The number and size of the holes in the disc on the one hand and the valve opening behaviour on the other hand are so conceived that there is always a greatly reduced and almost constant pressure, e.g. 1 bar, in the space between the valve and the disc when the pressure in the water line exceeds this constant pressure. In this way, a great volume of water with a good jet pattern can be produced through comparatively large and numerous holes although the pressure is relatively low. The holes 3 in the disc 2 are kept free of impurities, deposits, etc. by slight distortions on the disc caused by variations in pressure in the mains supply lines.

If the shower pattern itself is to be changed, the length of the valve rod 4 is altered by means of the adjusting nut 8 so that the disc 2 buckles outwards and allows the shower jets to emerge in a divergent pattern. When turning the adjusting nut 8, the valve cone 5 must be pulled on to its seat 6 to preclude the possibility of the valve rod turning with it.

Naturally a turning lock arranged in the shower head casing can also be provided for the valve rod.

While the principles of the invention have been described above in connection with specific apparatus and applications, it is to be understood that this description is made only by way of example and not as a limitation on the scope of the invention.

I claim:

1. A shower head for regulating the flow of water comprising a shower head casing, a flexible diaphragm-like disc retained by its edge in the shower head casing, a plurality of outlet holes arranged in said flexible disc, means supporting the center of the disc on one end of a valve rod, and a valve cone supported concentrically on the other end of the valve rod, the valve cone being fitted to a valve seat in the shower head casing to form a valve capable of being adjusted to opened and closed positions.

2. A shower head in accordance with claim 1, including an opening in the valve cone forming a bypass in the valve cone permitting a minimum amount of water to pass through to the disc when the valve is in the closed position.

3. A shower head in accordance with claim 1, in which the means supporting the disc at one end of the valve rod includes a threaded adjusting nut rotatably embedded in the disc and rotation of the adjusting nut enables flexure of the disc to enable the shower pattern to be changed between parallel and divergent shower jet emergence.

4. A shower head in accordance with claim 2, in which the means supporting the disc at one end of the valve rod includes a threaded adjusting nut rotatably embedded in the disc and rotation of the adjusting nut enables flexure of the disc to enable the shower pattern to be changed between parallel and divergent shower jet emergence.

5. A shower head in accordance with claim 1, in which a mechanism, accessible from outside the shower head is provided for adjusting the shower pattern.

6. A shower head in accordance with claim 2, in which a mechanism, accessible from outside the shower head, is provided for adjusting the shower pattern.

7. A shower head in accordance with claim 3, in which a mechanism accessible from outside the shower head, is provided for adjusting the shower pattern.

* * * * *